US006715865B2

(12) United States Patent
Yamaguchi et al.

(10) Patent No.: US 6,715,865 B2
(45) Date of Patent: Apr. 6, 2004

(54) LIQUID JET RECORDING HEAD PACKING METHOD, LIQUID JET RECORDING HEAD AND LIQUID JET RECORDING APPARATUS

(75) Inventors: Yukuo Yamaguchi, Tokyo (JP); Yutaka Koizumi, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/187,809

(22) Filed: Jul. 3, 2002

(65) Prior Publication Data

US 2003/0016278 A1 Jan. 23, 2003

(30) Foreign Application Priority Data

Jul. 9, 2001 (JP) ..... 2001-208412

(51) Int. Cl.[7] ..... B41J 2/175
(52) U.S. Cl. ..... 347/87; 347/86
(58) Field of Search ..... 347/85, 86, 87, 347/56

(56) References Cited

U.S. PATENT DOCUMENTS 5,682,190 A 10/1997 Hirosawa et al. ..... 347/94
6,022,102 A * 2/2000 Ikkatai et al. ..... 347/85
6,234,615 B1 * 5/2001 Tsukuda ..... 347/85
6,390,611 B1 * 5/2002 Kobayashi et al. ..... 347/84
6,454,398 B2 * 9/2002 Kobayashi et al. ..... 347/85
6,540,343 B1 * 4/2003 Umeyama et al. ..... 347/93

* cited by examiner

*Primary Examiner*—Anh T. N. Vo
(74) *Attorney, Agent, or Firm*—Fitzpatrick, Cella, Harper & Scinto

(57) ABSTRACT

A liquid jet recording head packing method can effectively suppress the problem of leakage of liquid from a liquid jet recording head due to expansion of the liquid and/or the gas in the liquid chamber when the liquid jet recording head that is provided with a chamber for containing liquid is packed and subsequently subjected to abrupt changes in the environment. The liquid jet recording head comprises a head chip provided with nozzles for ejecting liquid and a frame having a second common liquid chamber for storing liquid to be supplied to the head chip. A joint rubber member is forcibly driven into each of a number of holes arranged in part of the frame and a pipe member is driven into the fissure hole of each of the joint rubber members in order to keep the inside of the second common liquid chamber in a state where it communicates to a peripheral area of the liquid jet recording head by way of the joint rubber members.

9 Claims, 13 Drawing Sheets

LIQUID JET RECORDING HEAD PACKING METHOD, LIQUID JET RECORDING HEAD AND LIQUID JET RECORDING APPARATUS

BACKGROUND OF THE INVENTION

1. Field of the Invention

This invention relates to a method of packing a liquid jet recording head to be used for printing by ejecting liquid droplets from ejection orifices onto a printing medium. The present invention also relates to a liquid jet recording head and a liquid jet recording apparatus equipped with such a liquid jet recording head.

2. Related Background Art

Conventional liquid jet recording apparatus comprise a carriage adapted to reciprocate in a direction almost perpendicular to the moving direction of the recording medium, and a liquid jet recording head is mounted on the carriage.

The liquid jet recording head comprises as principal components thereof a liquid jet section for ejecting liquid from its ejection orifices onto a recording medium for the purpose of recording and a liquid storage chamber containing liquid to be supplied to the liquid jet section. There are exemplified liquid jet recording heads that typically comprise a liquid storage section as an integral part thereof and can be replaced for the liquid jet recording apparatus on which they are mounted.

Such liquid jet recording heads are not adapted to be refilled with liquid when the liquid contained therein is used up. In other words, when the liquid initially contained in a liquid jet recording head is totally consumed, the latter is disposed as waste and a new one is mounted on the scanning carriage. With such an arrangement, the running cost of the liquid jet recording apparatus will be high particularly when the liquid jet recording head is replaced frequently.

On the other hand, there are exemplified liquid jet recording heads of the type designed to reduce the running cost and provided with a separate liquid storage section so that only the latter may be replaced when all the liquid contained in the section is consumed. There are also known liquid jet recording heads of the type provided with an external liquid storage chamber from which liquid is supplied to the liquid jet recording head. Liquid jet recording heads of these types are also designed to reduce the running cost.

In short, known liquid jet recording heads are classified into (1) those that are provided with a liquid storage chamber arranged in the inside of the liquid jet recording head, (2) those that are provided with a replaceable liquid storage chamber and (3) those that are supplied with liquid from a remote liquid storage chamber connected thereto typically by means of a pipe.

Regardless of the type of liquid jet recording heads, however, the internal pressure of the head is normally held to a level lower than the atmospheric pressure or to a negative pressure level relative to the outside of the head in order to prevent liquid from leaking out of the liquid jet recording head.

Now, some of the characteristic aspects of the negative pressure generating means of the liquid supply system of a liquid jet recording head of each of the above identified types will be discussed below.

In the case of a liquid jet recording head provided with a liquid storage chamber arranged in the inside thereof, the liquid storage chamber is normally equipped with a negative pressure generating means for maintaining the negative pressure in the liquid storage chamber. The negative pressure generating means may be a liquid absorbing means (liquid absorption system), a mechanical means or some other means.

A liquid absorption means is typically designed to utilize the capillary force of a porous liquid absorbing material such as urethane in order to maintain the negative pressure in the liquid storage chamber and, at the same time, retain the liquid therein. A mechanical means is typically adapted to utilize the resilient force of an elastic body so as to contract a flexible wall, thereby maintaining the negative pressure in the liquid storage chamber.

Now, a liquid jet recording head provided with a replaceable liquid storage chamber will be described below. A liquid absorption system is typically employed as negative pressure generating means in a liquid jet recording head provided with a replaceable liquid storage chamber. More specifically, such a liquid absorption system is adapted to prevent liquid in the storage chamber from dropping through the connection port of the liquid storage chamber by means of the liquid retaining force of the porous liquid absorption member thereof.

Next, a liquid jet recording head adapted to be supplied with liquid from an external liquid storage chamber will be discussed below. A liquid jet recording head of this type may be provided with a negative pressure generating means of the liquid absorption type or of the mechanical type or may be adapted to maintain the negative pressure in the liquid jet recording head by means of the water head difference that is produced as a result of the fact that the liquid level in the external liquid storage chamber is lower than the level of the plane of the ejection orifices of the liquid jet recording head.

A liquid jet recording head may be made to eject liquid droplets from its ejection orifices by utilizing thermal energy generated by electro-thermal transducers or by deflecting liquid droplets by means of a pair of electrodes. Liquid jet recording heads adapted to eject liquid droplets by utilizing thermal energy are commercially available and very popular because of the advantages thereof including that liquid ejection orifices for forming liquid droplets that are to be ejected for the purpose of recording can be arranged densely and high resolution images can be formed by this arrangement as well as that the entire head can be made compact with ease.

In ink-jet recording head adapted to eject recording liquid by utilizing thermal energy comprises ejection orifices for ejecting liquid, liquid flow paths communicating to the respective ejection orifices and electro-thermal transducers arranged vis-à-vis the respective flow paths so that it applies ejection energy (e.g., thermal energy for causing liquid to give rise to film boiling) coming from the electro-thermal transducers to the liquid flowing through the liquid flow paths and ejects droplets of liquid through the ejection orifices for a recording operation.

In recent years, ink-jet recording apparatus of various types have been developed and become very popular. Additionally, the recording capacity of such apparatus has been increased so that the consumption of recording liquid is also increasing. As a result, the demand for ink-jet recording apparatus having a large liquid storage capacity has been rising rapidly.

However, liquid jet ejection heads of the above described types (1) through (3), those of the type (1) having a liquid storage chamber as an integral component thereof and those of the type (2) provided with a replaceable liquid storage chamber are accompanied by the problem of a limited capacity of the liquid storage chamber. In other words, the liquid storage chamber or the liquid jet recording head itself has to be replaced frequently to impose a cumbersome replacing operation to the operator (user) particularly when recording liquid is consumed at a high rate. Furthermore, the cost of such consumables is far from negligible.

If, on the other hand, the capacity of the liquid storage chamber is raised, the total weight of the liquid jet recording head increases to raise the inertial force that is produced in the scanning operation of the carriage. Then, there arises a problem that the carriage may not be stable nor reliable for scanning operations to consequently degrade the quality of recording.

Additionally, if the capacity of the liquid storage chamber that is mounted on the carriage is raised, the entire liquid jet recording apparatus may become bulky.

Contrary to liquid jet ejection heads of the above two types, those of the type (3) provided with an external liquid chamber, from which liquid is supplied, are advantageous in that the liquid storage chamber can be placed relatively freely and the recording apparatus is free from becoming bulky if the capacity of the liquid storage chamber is raised.

Additionally, the arrangement of maintaining the negative pressure in the liquid jet recording head by means of the water head difference between the level of the plane of the ejection orifices of the liquid jet recording head and that of the liquid in the liquid storage chamber that is external relative to the head is very simple to provide the advantage of reducing the cost of the apparatus, if compared with the means of producing negative pressure by using a liquid absorption system or a mechanical system.

However, the arrangement of maintaining the negative pressure in the liquid jet recording head by means of the water head difference is also accompanied by the problem, which will be discussed below.

If the liquid jet recording head is subjected to vibrations during transportation and/or unexpected impacts, some of the liquid in the liquid jet recording head can leak out of the head. Generally speaking, if the liquid jet recording head is adapted to eject large liquid droplets having a size greater than 10 pl and its ejection orifices have a large area, the ejection orifices of the liquid jet recording head are covered and protected by a protection tape that seals them when the liquid jet recording head is packed so that no printing liquid may leak out of the ejection orifices. If, on the other hand, the liquid jet recording head is adapted to eject small liquid droplets having a size smaller than 10 pl and its ejection orifices have a small area, the liquid jet recording head can be packed without using a protection tape for sealing the ejection orifices because the printing liquid in the inside is prevented from moving by the high meniscus retaining effect of the ejection orifices. However, with the above packing method of using a tape, the internal pressure of the liquid jet recording head can become very high when it is brought into a situation where the environment can change abruptly due to expansion of the liquid and/or the gas in the liquid chamber of the liquid jet recording head.

Then, if the liquid jet recording head is adapted to eject large liquid droplets and the ejection orifices are covered by a protection tape, the tape can be moved away from the plane of the ejection orifices to allow printing liquid to leak out. Similarly, printing liquid is allowed to scatter from the ejection orifices if the liquid jet recording head is adapted to eject small liquid droplets and the ejection orifices are not covered by a protection tape. Furthermore, liquid will also flow out of the liquid jet recording head if the filler sealing the areas connecting some of the components of the liquid jet recording head is destroyed. Thus, conventional liquid jet recording heads of this type require that the areas connecting some of the components of the liquid jet recording head have to be reliably and hermetically sealed by means of strong fillers so that the head can withstand any abrupt changes in the environment. However, this requirement inevitably results in a high manufacturing cost.

SUMMARY OF THE INVENTION

In view of the above identified circumstances, it is therefore the object of the present invention to provide a liquid jet recording head packing method, a liquid jet recording head and a liquid jet recording apparatus equipped with a liquid jet recording head that can effectively suppress the problem of leakage of liquid from the liquid jet recording head due to expansion of the liquid and/or the gas in the liquid chamber when the liquid jet recording head that is provided with a chamber for containing liquid is packed and subsequently subjected to abrupt changes in the environment.

In an aspect of the invention, the above object is achieved by providing a method of packing a liquid jet recording head comprising a plurality of ejection orifices for ejecting liquid droplets, a plurality of flow paths respectively communicating to said ejection orifices, a plurality of energy generating elements arranged respectively vis-à-vis said flow paths and adapted to generate energy for respectively ejecting the liquid in said flow paths from said ejection orifices, a first common liquid chamber arranged upstream relative to said flow paths so as to supply liquid to said flow paths, a liquid supply path for supplying liquid to said first common liquid chamber, a second common liquid chamber arranged upstream relative to said liquid supply path so as to store liquid to be supplied to said liquid supply path, a frame forming said second common liquid chamber and a porous member arranged between said liquid supply path and said second common liquid chamber;

said frame being provided at part thereof with a hole section to be used for pouring liquid into said second common liquid chamber, an elastic peg member being arranged in said hole section so as to block up said hole section, said peg member being provided with a fissure hole, said peg member being so arranged as to allow liquid to be supplied into said second common liquid chamber with a hollow needle member driven into said fissure hole of said peg member in order to supply liquid into said second common liquid chamber;

said method comprising the step of packing said liquid jet recording head while holding a pipe member driven into the fissure hole of said peg member.

With a packing method according to the invention, preferably, the cross section of the peg member as viewed in a direction perpendicular to the central axis thereof is greater than the cross section of the hole section of the frame as viewed in a direction perpendicular to the longitudinal axis thereof, and said pipe member is driven into the fissure hole of said peg member forcibly driven into said hole section of the liquid jet recording head.

Preferably, said pipe member is driven into the fissure hole of said peg member in such a way it is subsequently pushed into said second common liquid chamber by said needle member driven into said peg member and falls from said peg member.

Preferably, said pipe member is made of a resin material or polytetrafluoroethylene.

Preferably, said porous member is filled with liquid at a part thereof located downstream in the sense of supply of liquid while liquid is removed from said porous member at a part thereof located upstream in the sense of supply of liquid when packing said liquid jet recording head.

Preferably, said ejection orifices are tightly sealed by a removable sealing member before removing liquid from said second common liquid chamber when packing said liquid jet recording head.

Preferably, the packing member for packing said liquid jet recording head is made of a material adapted to block permeation of liquid and gas.

In another aspect of the invention, there is provided a liquid jet recording head comprising a plurality of ejection orifices for ejecting liquid droplets, a plurality of flow paths respectively communicating to said ejection orifices, a plurality of energy generating elements arranged respectively vis-à-vis said flow paths and adapted to generate energy for respectively ejecting the liquid in said flow paths from said ejection orifices, a first common liquid chamber arranged upstream relative to said flow paths so as to supply liquid to said flow paths, a liquid supply path for supplying liquid to said first common liquid chamber, a second common liquid chamber arranged upstream relative to said liquid supply path so as to store liquid to be supplied to said liquid supply path, a frame forming said second common liquid chamber and a porous member arranged between said liquid supply path and said second common liquid chamber;

said frame being provided at part thereof with a hole section to be used for pouring liquid into said second common liquid chamber, an elastic peg member being arranged in said hole section so as to block up said hole section, said peg member being provided with a fissure hole, said peg member being so arranged as to allow liquid to be supplied into said second common liquid chamber with a hollow needle member driven into said fissure hole of said peg member in order to supply liquid into said second common liquid chamber;

wherein a pipe member is held in the fissure hole of said peg member.

In still another aspect of the invention, there is provided a liquid jet recording apparatus comprising a carriage adapted to mount a liquid jet recording head thereon and reciprocate, a main tank for storing liquid to be supplied to the second common liquid chamber of said liquid jet recording head, a hollow needle member to be driven into the fissure hole of the peg member of said liquid jet recording head mounted on said carriage to supply liquid from said main tank into said second common liquid chamber and a drive means for driving said needle member so as to push said pipe member held in said peg member into said second common liquid chamber.

A liquid jet recording head to which a packing method according to the invention is applied is mounted on the carriage of a liquid jet recording apparatus main body in such a way that the plane of its ejection orifices is located above the level of the liquid in the liquid storage chamber arranged outside the recording head. The negative pressure of the inside of the liquid jet recording head is maintained by the water head difference between the plane of the ejection orifices of the liquid jet recording head and the level of the liquid in the external liquid storage chamber. Then, as the needle members provided in the liquid jet recording apparatus having such a configuration are driven into the second common liquid chamber respectively through the fissure holes of the corresponding peg members that have been forcibly driven into the respective holes arranged at a lateral side of the second common liquid chamber (auxiliary liquid storage chamber) of the liquid jet recording head, liquid is supplied from the external liquid storage chamber to the liquid jet recording head. Thus, according to the invention, since peg members are provided with fissure holes for holding the pipe members, the needle members can be respectively driven into the fissure holes of the corresponding peg members and pulled out of them without problem. As a result, the load applied to the needle members when they are driven into the peg members and pulled out of them is reduced and hence the liquid jet recording head can be replaced with ease. Additionally, if the center of each of the needle members and that of the corresponding peg member are misaligned relative to each other, the peg member is depressed along the periphery of the fissure hole as the needle member is driven into the peg member from the front end thereof due to the pressure applied to the needle member, so that the front end of the needle member is guided by the fissure hole. In other words, the needle member can reliably be driven into the peg member without requiring a high precision level for the dimensions of both the needle member and the peg member. The operation of driving the needle member is further improved if the fissure hole is branched from the central axis of the peg member at least in three directions.

When packing the liquid jet recording head, the second common liquid chamber is prevented from being completely closed by driving a pipe member into the fissure hole of each of the peg members so as to be held therein. Then, the internal pressure of the liquid jet recording head is prevented from rising extremely if the liquid jet recording head is subjected to an abrupt change in the environment. In other words, if the liquid jet recording head is packed and subjected to an abrupt change in the environment, the risk of liquid leaking from the inside of the liquid jet recording head through the ejection orifices due to unexpected expansion of liquid and/or gas in the liquid chamber is suppressed. Additionally, if the pipe members are held respectively in the fissure holes of the corresponding peg members, the opening of each of the fissure holes is expanded by the corresponding pipe member to reduce the friction that arises when a needle member is driven into the peg member so that the needle member can be driven into the fissure hole with very small driving force.

If each of the peg members is pushed into a hole section whose diameter is smaller than that of the peg member, the fissure hole of the peg member is completely closed by the resiliency of the peg member (compressive force applied to the outer periphery thereof) so that no liquid nor air will leak to the outside through the fissure hole to a great advantage of the liquid jet recording head. Additionally, in a state where a needle member is driven into each of the peg members, the needle member is firmly gripped by the peg member so that again no liquid nor air will leak to the outside. Furthermore, since the pipe members that are driven respectively into the fissure holes of the corresponding peg members at the time of packing are also firmly gripped by the peg members, they are prevented from moving relative to the peg members and eventually coming out from the latter if the liquid jet recording head is subjected to large vibrations and/or impacts. Therefore, the pipe members are reliably held by the peg members if they are made very short to reduce the cost of the pipe members.

Additionally, as a porous member that shows a large pressure loss is provided, the liquid found in the flow path where the energy generating elements are arranged, the first common liquid chamber and the liquid supply path, which are located downstream relative to the porous member, can hardly move. Therefore, a situation in which liquid flows from this region into the second common liquid chamber through the porous member will hardly take place. Furthermore, when the ejection orifices are hermetically sealed by a sealing member, problems involving no liquid ejection will be prevented from occurring, because printing liquid is prevented from drying at and near the ejection orifices and any of the ingredients of printing liquid is prevented from adhering to and near the energy generating elements.

Finally, when mounting the liquid jet recording head on the liquid jet recording head and subsequently driving the needle members into the respective peg members, the front ends of the needles members push respectively the corresponding pipe members until the pipe members are released from the peg members and forced to fall into the second common liquid chamber. Thus, the operator does not need to pull out the pipe members when installing the liquid jet recording head.

DETAILED DESCRIPTION OF THE PREFERRED EMBODIMENTS

Figure 1:
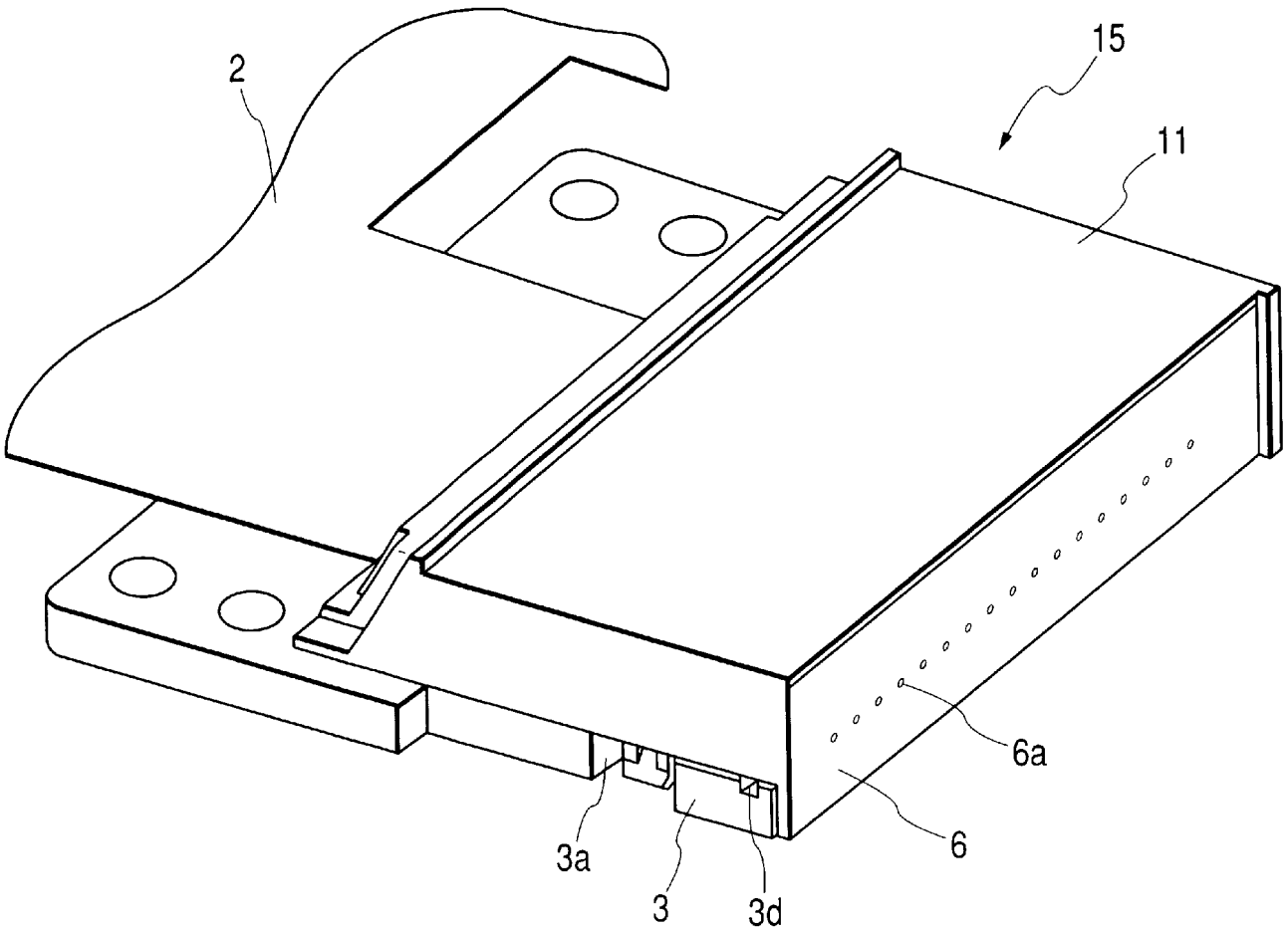
FIG. 1 is a schematic perspective view of an embodiment of liquid jet recording head according to the invention, illustrating a possible configuration of the liquid droplet ejecting section.
Figure 2:
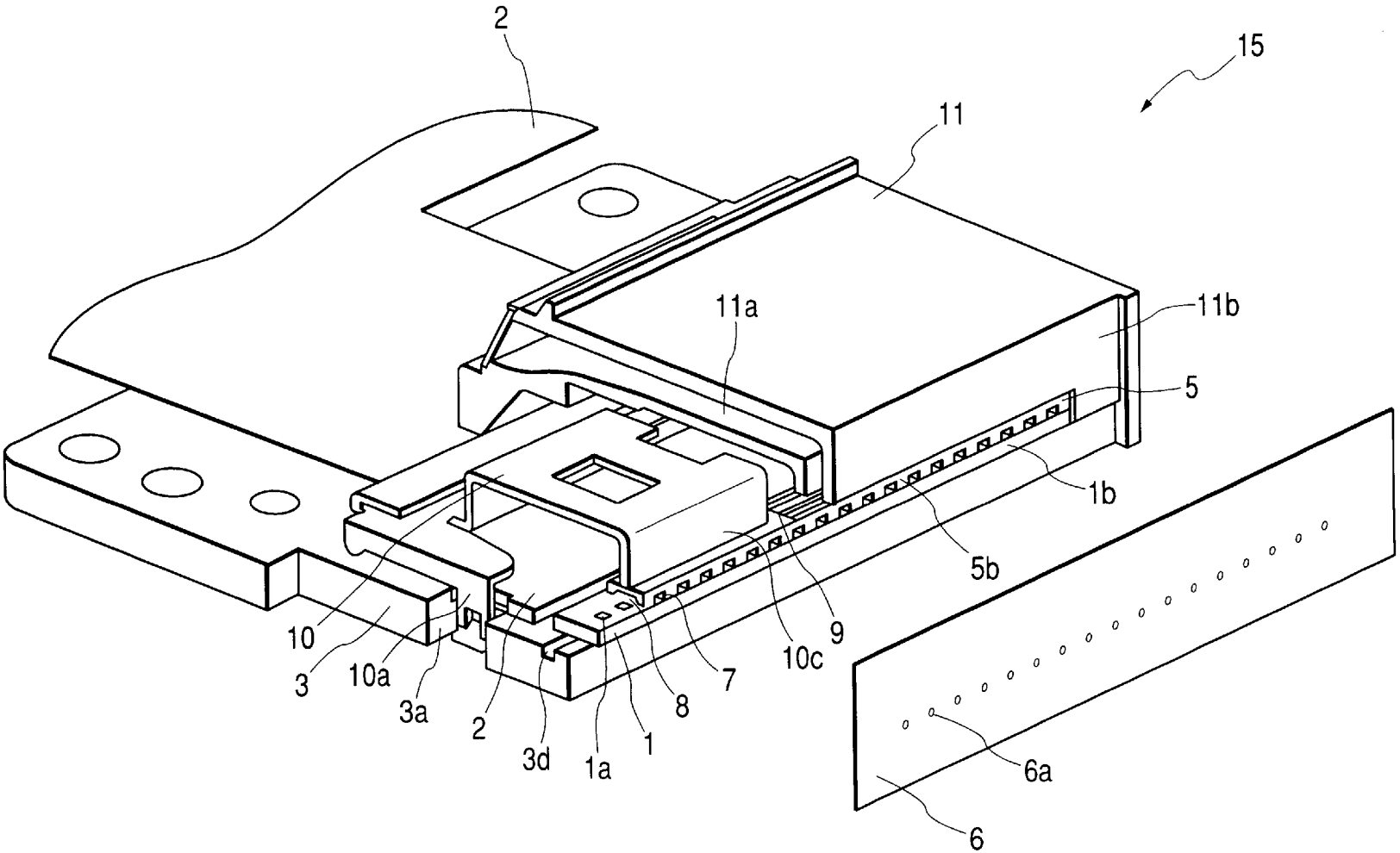
FIG. 2 is a schematic perspective view of the liquid droplet ejecting section of FIG. 1, illustrating a part thereof in cross section.
Figure 3:
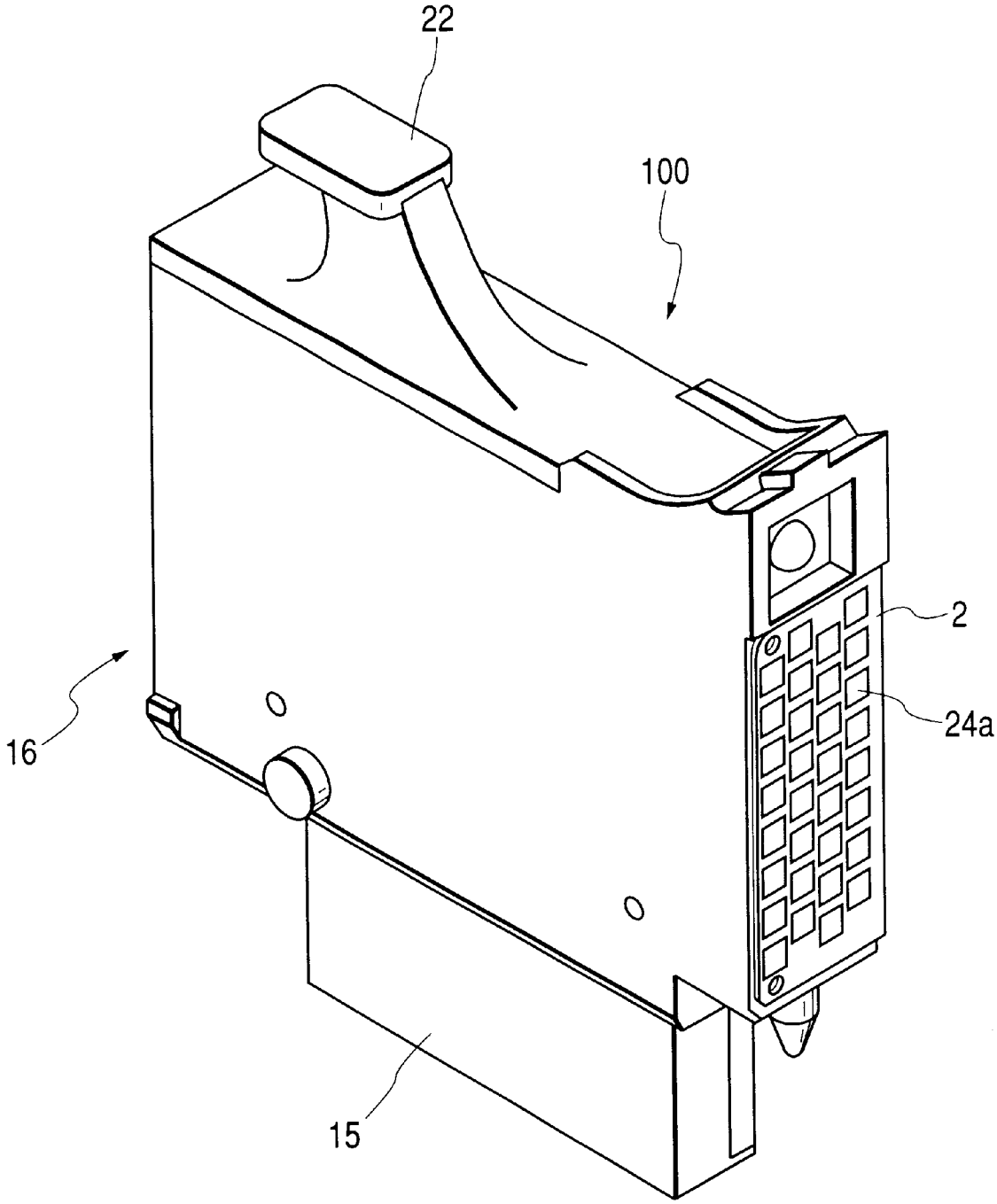
FIG. 3 is a schematic perspective view of the liquid jet recording head of FIG. 1 as viewed for a side thereof.
Figure 4:
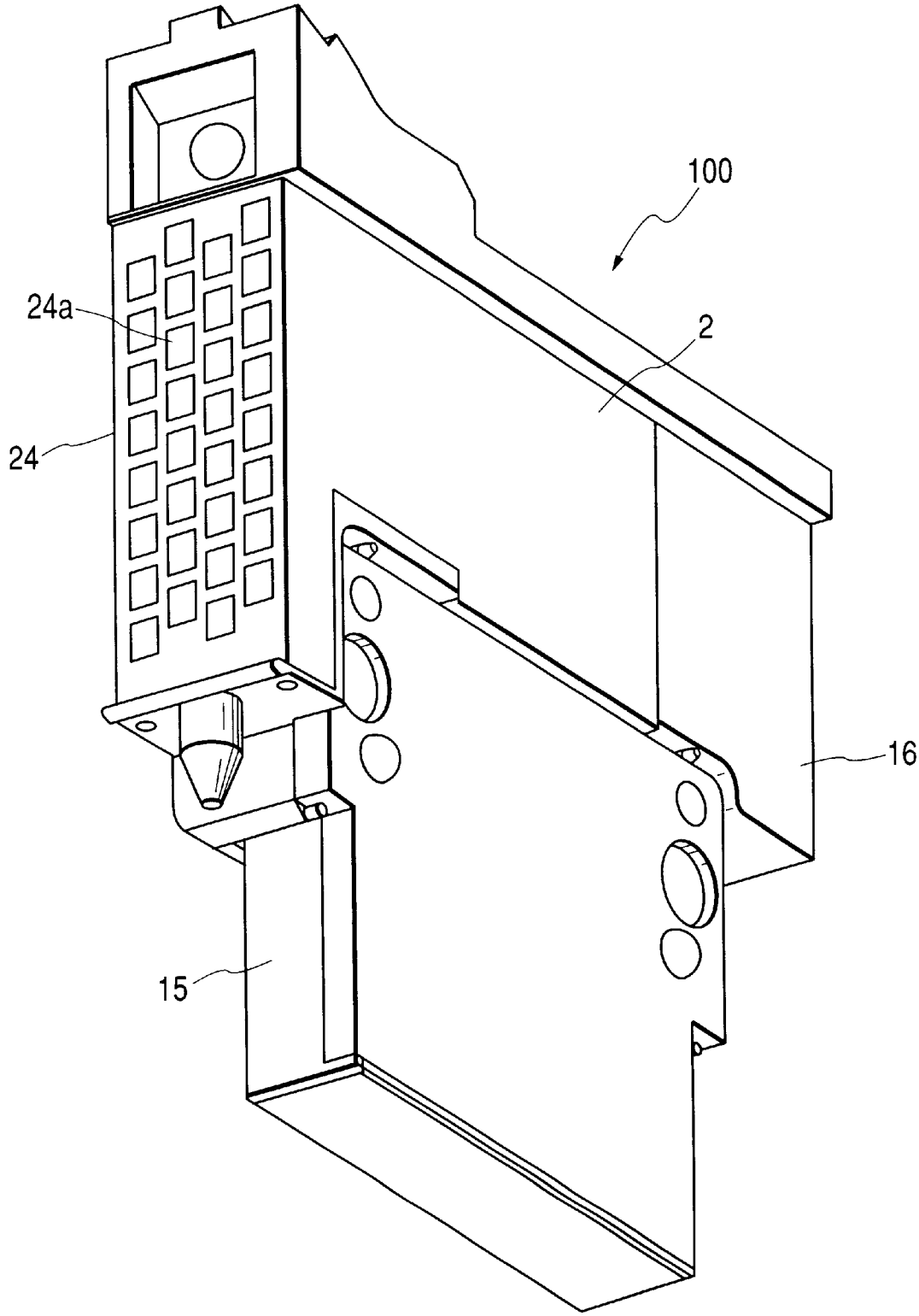
FIG. 4 is a schematic perspective view of the liquid jet recording head of FIG. 1 as viewed from the opposite side thereof.
Figure 5:
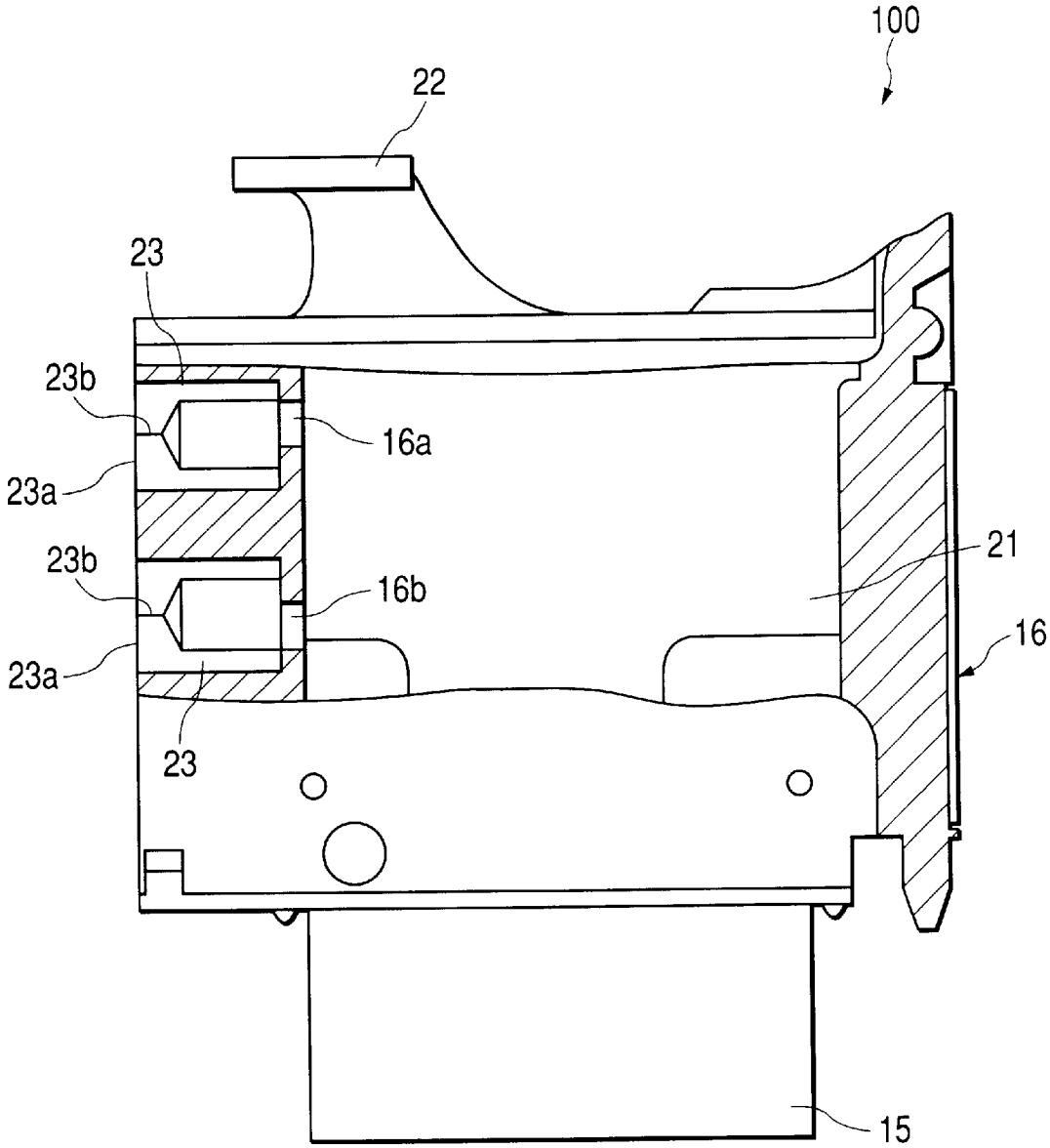
FIG. 5 is a schematic partial cross sectional view of the liquid jet recording head of FIG. 1.
Figure 6A:
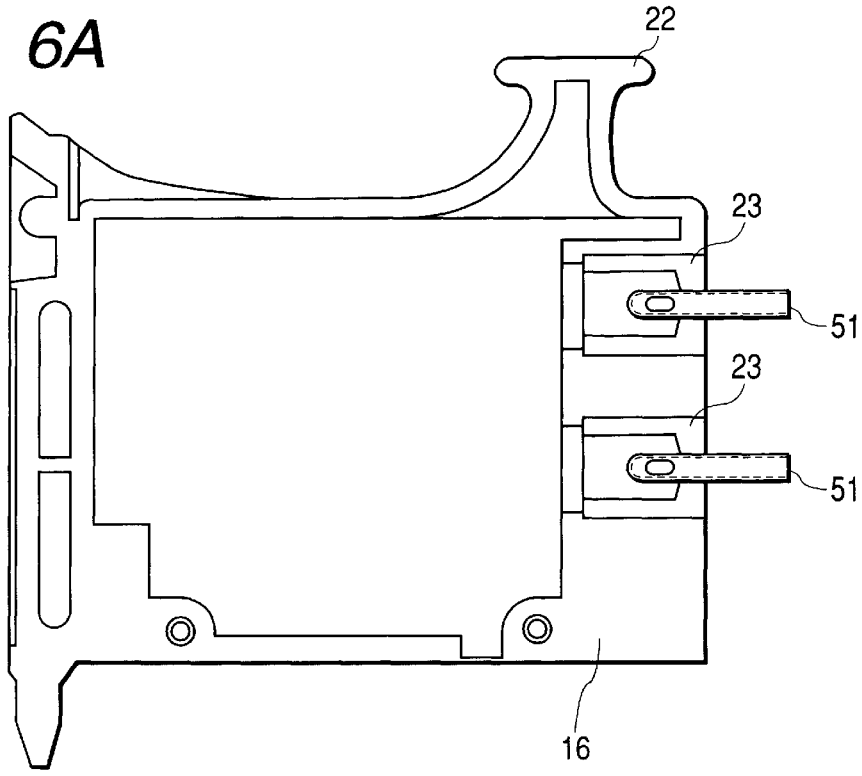
FIGS. 6A and 6B are schematic partial cross sectional views of the liquid jet recording head, illustrating the operation of supplying printing liquid into the liquid jet recording head.
Figure 6B:
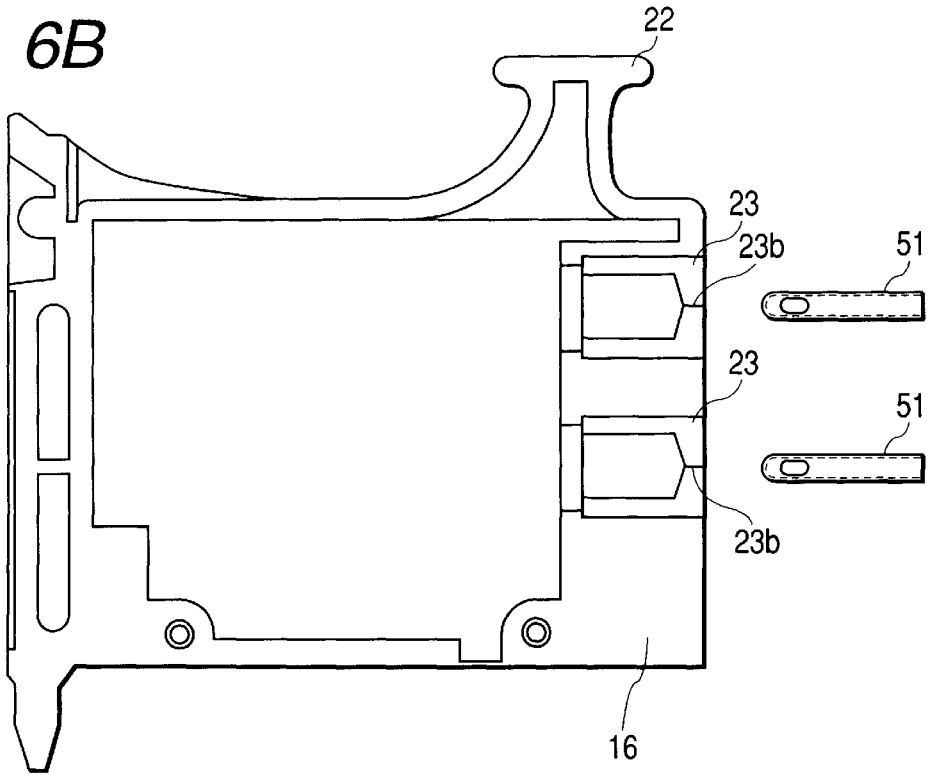
Figure 7:
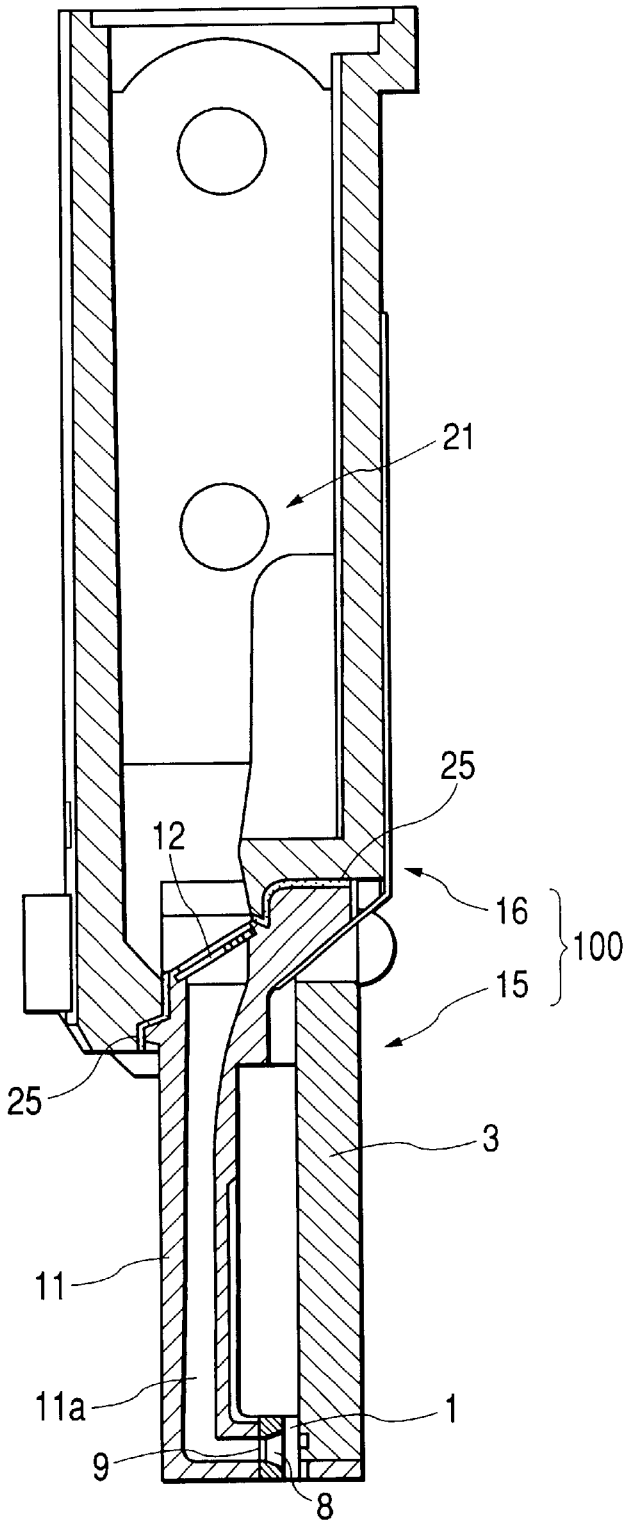
FIG. 7 is a schematic cross sectional view of the liquid jet recording head.
Figure 8:
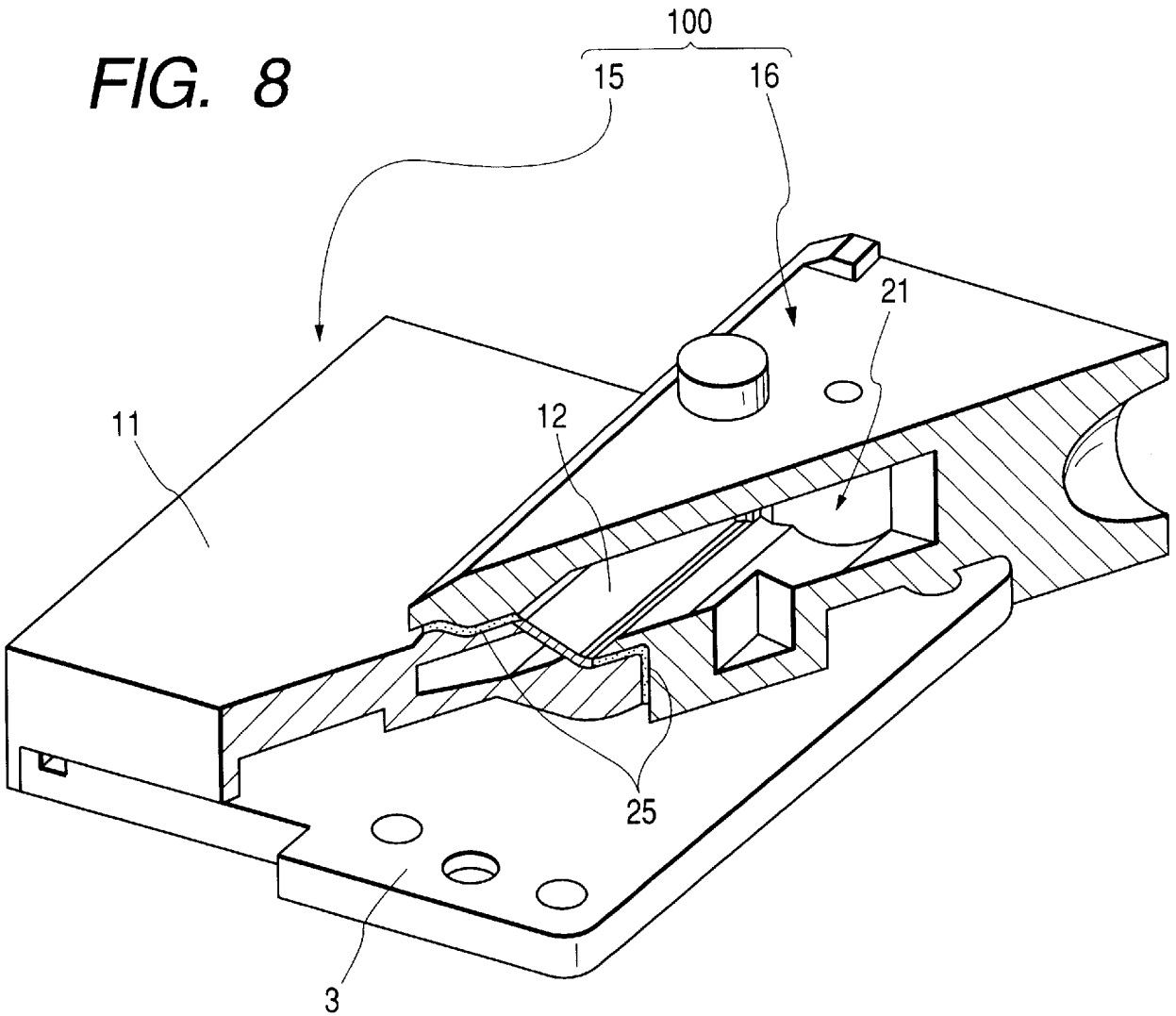
FIG. 8 is a schematic partial cross sectional view of the liquid jet recording head.
Figure 9:
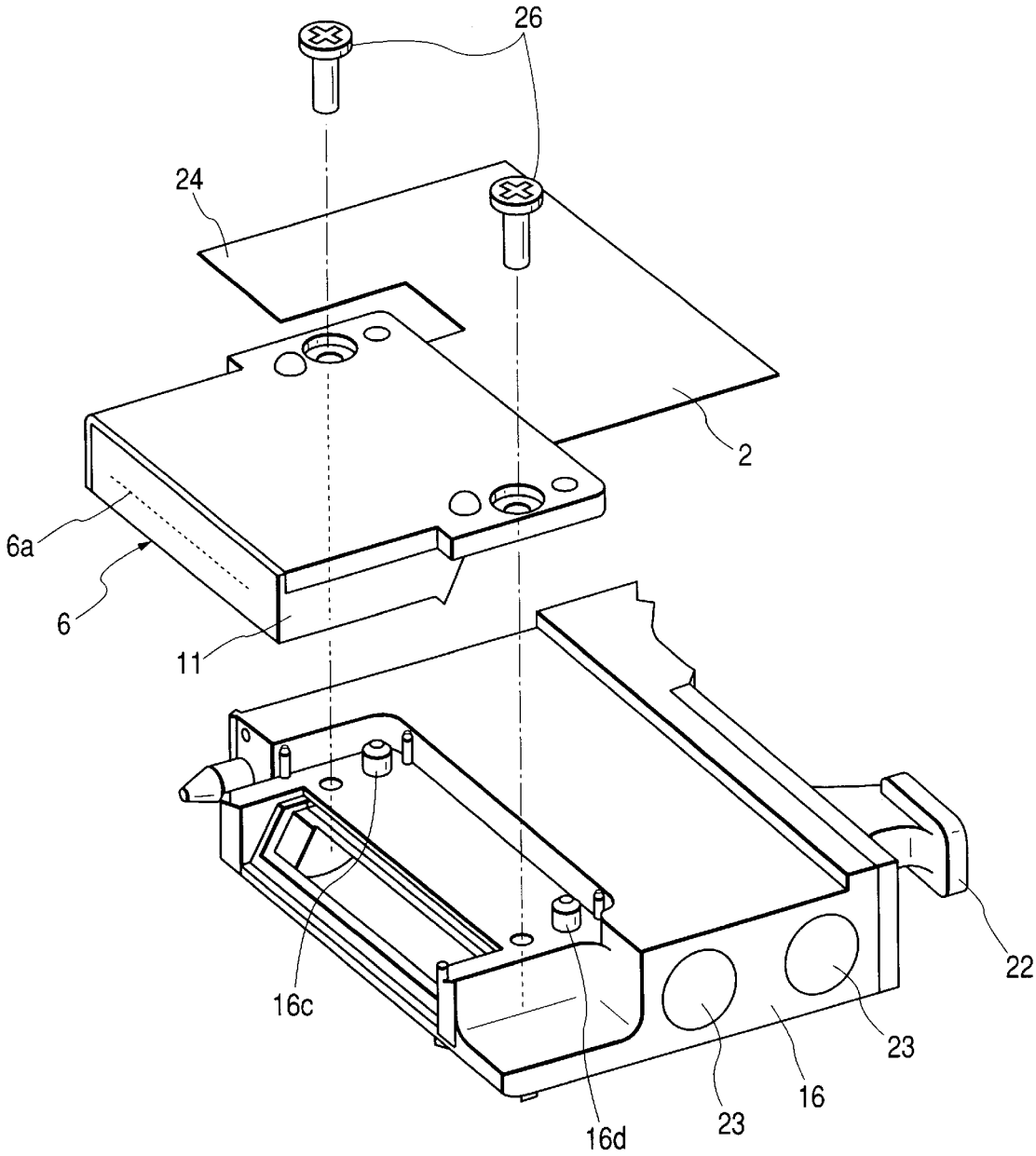
FIG. 9 is an exploded perspective view of the liquid jet recording head, illustrating its structure.
Figure 10:
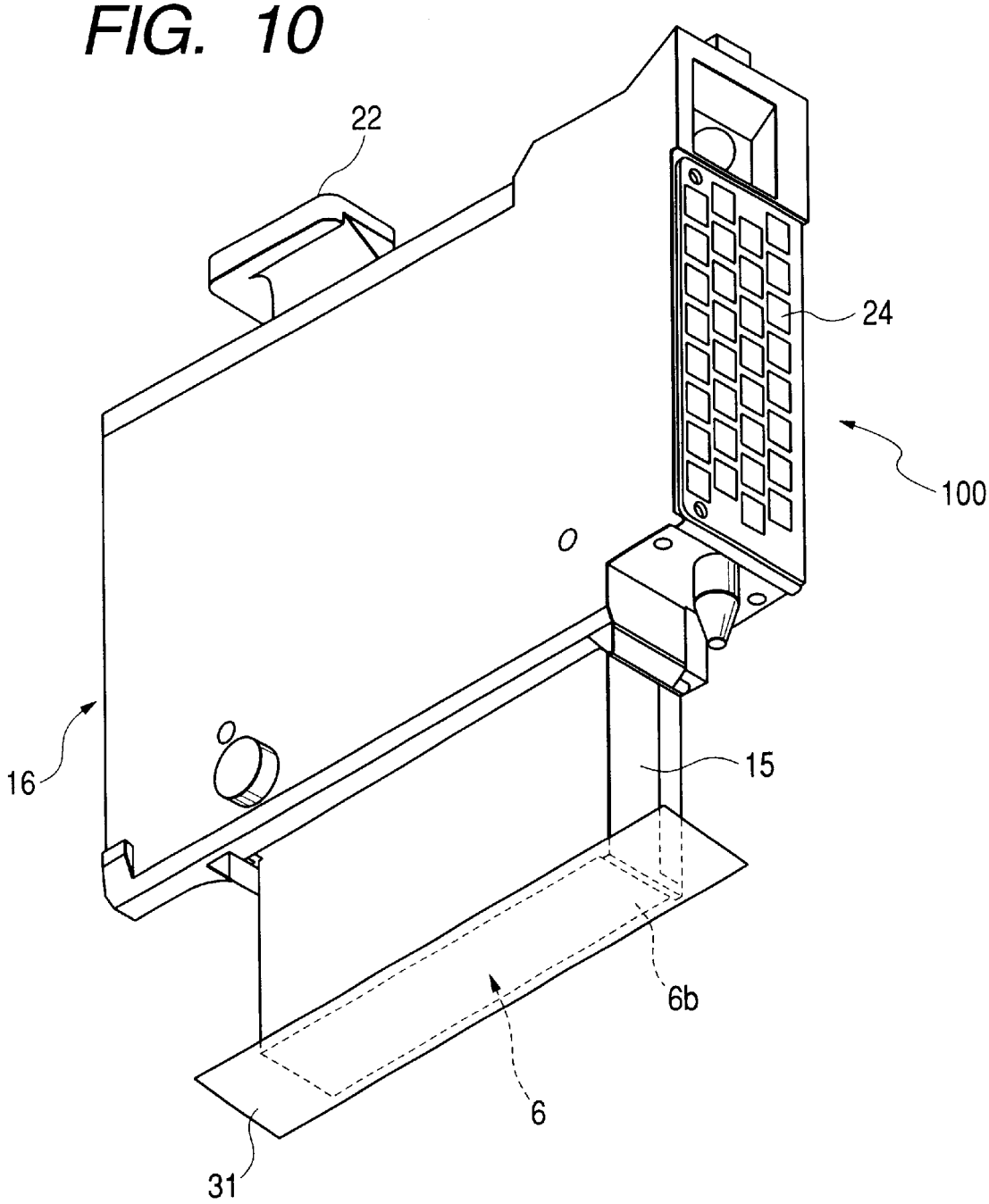
FIG. 10 is a schematic perspective view of the liquid jet recording head, illustrating a method of packing the head.
Figure 11A:
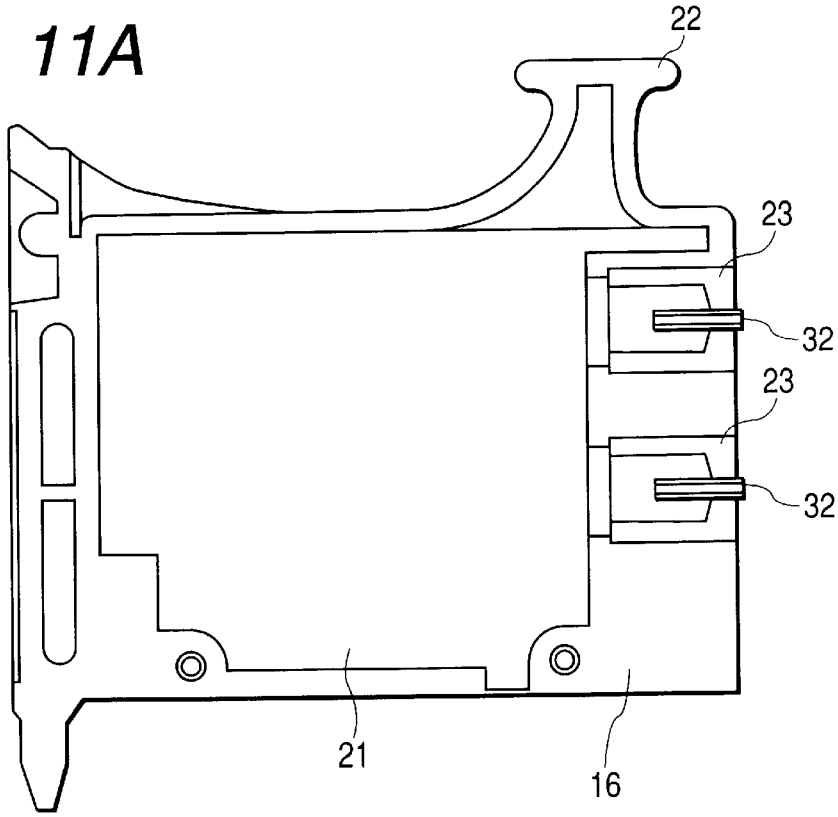
FIGS. 11A and 11B are schematic cross sectional views of the liquid jet recording head, illustrating the method of packing the head.
Figure 11B:
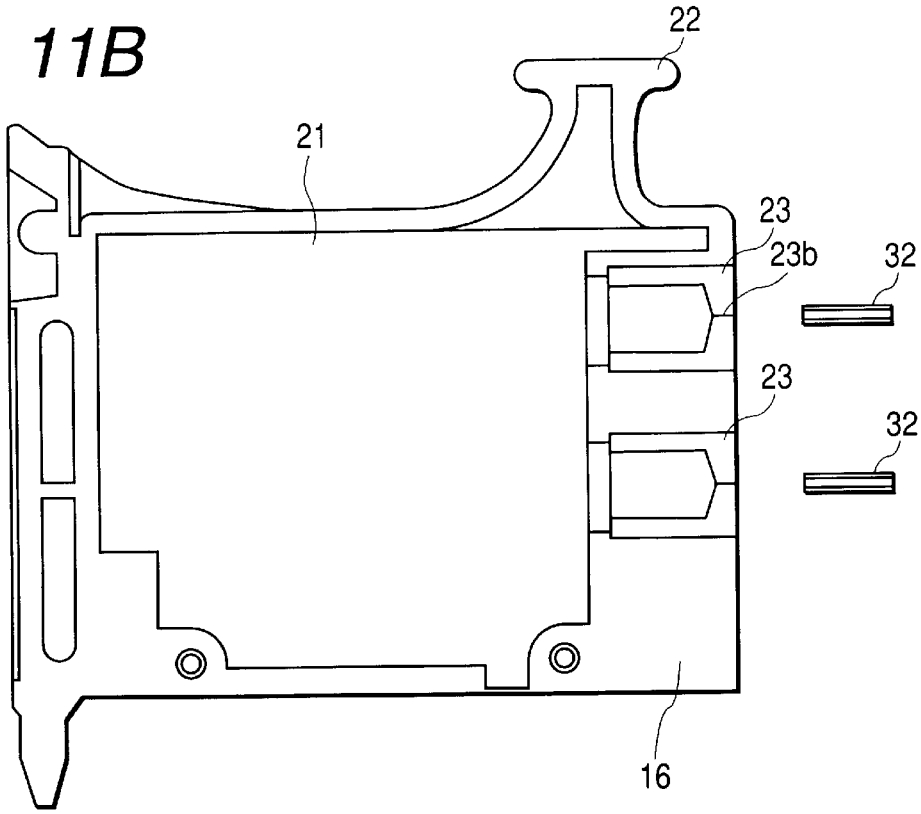

FIG. 1 is a schematic perspective view of an embodiment of liquid jet recording head according to the invention, illustrating a possible configuration of the liquid droplet ejecting section and FIG. 2 is a schematic perspective view of the liquid droplet ejecting section of FIG. 1, illustrating a part thereof in cross section, while FIG. 3 is a schematic perspective view of the liquid jet recording head of FIG. 1 as viewed for a side thereof and FIG. 4 is a schematic perspective view of the liquid jet recording head of FIG. 1 as viewed from the opposite side thereof. FIG. 5 is a schematic partial cross sectional view of the liquid jet recording head of FIG. 1 and FIGS. 6A and 6B are schematic partial cross sectional views of the liquid jet recording head, illustrating the operation of supplying printing liquid into the liquid jet recording head, while FIG. 7 is a schematic cross sectional view of the liquid jet recording head and FIG. 8 is a schematic partial cross sectional view of the liquid jet recording head. FIG. 9 is an exploded perspective view of the liquid jet recording head, illustrating its structure and FIG. 10 is a schematic perspective view of the liquid jet recording head, illustrating a method of packing the head, while FIGS. 11A and 11B are schematic cross sectional views of the liquid jet recording head, illustrating the method of packing the head.

Figure 12A:
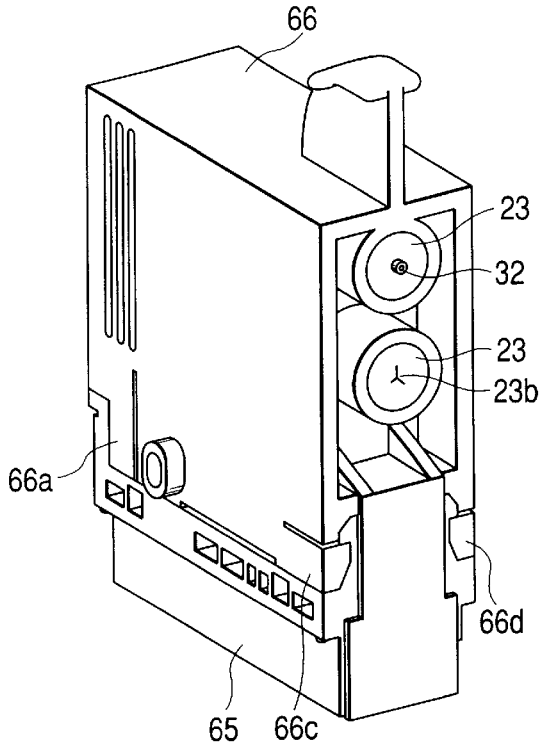
FIGS. 12A and 12B are schematic perspective views of another embodiment of liquid jet recording head according to the invention.
Figure 12B:
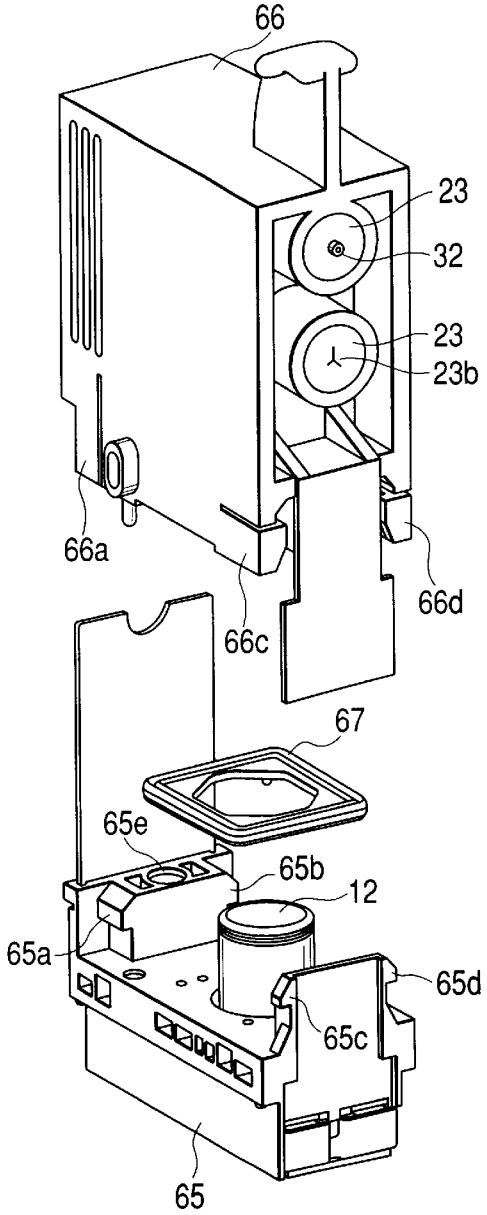
Figure 13:
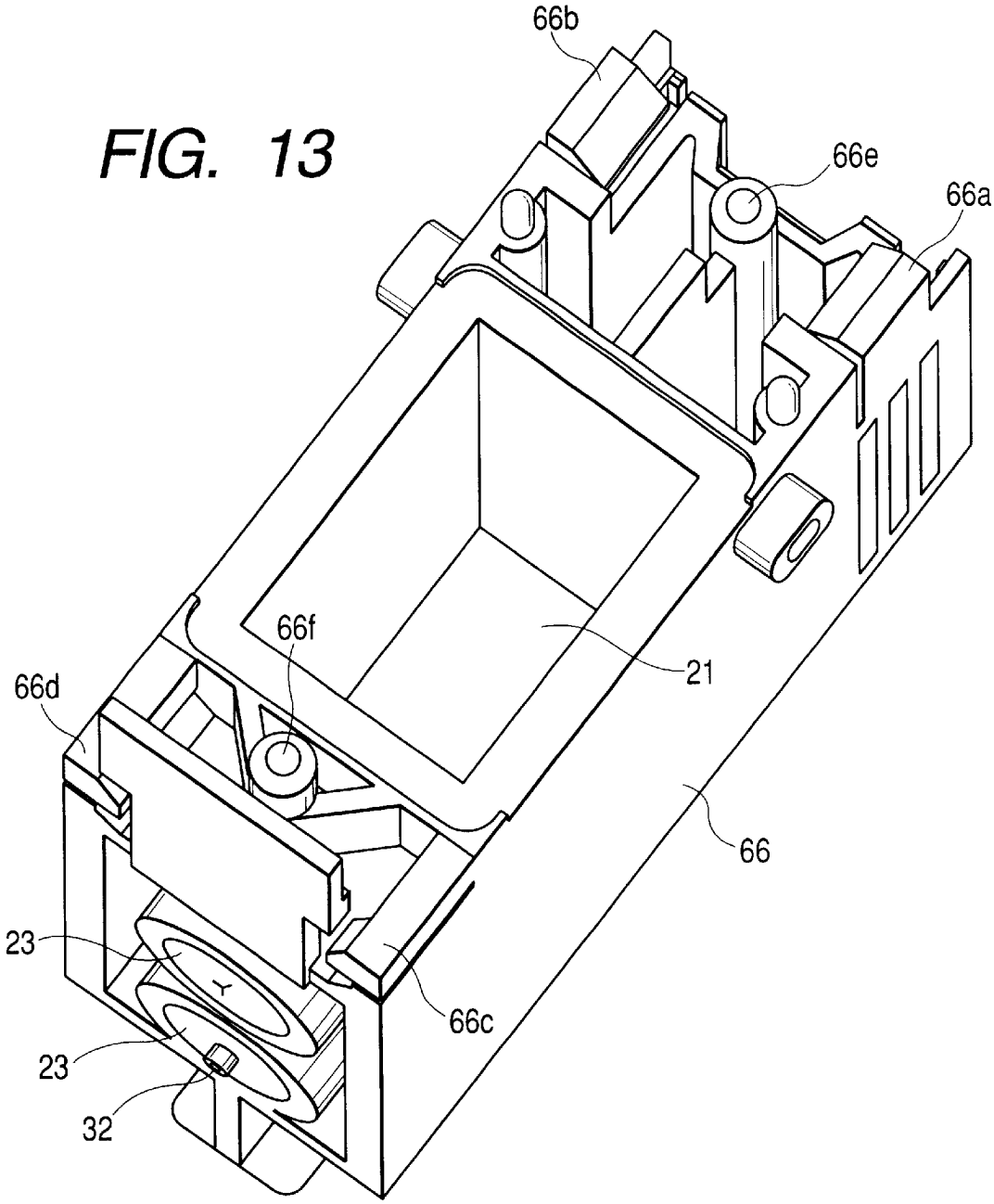
FIG. 13 is a schematic perspective view of the frame of the liquid jet recording head of FIGS. 12A and 12B.

FIGS. 12A and 12B are schematic perspective views of another embodiment of liquid jet recording head according to the invention, of which FIG. 12A is a schematic perspective view of the assembled liquid jet recording head and FIG. 12B is an exploded schematic perspective view of the liquid jet recording head. FIG. 13 is a schematic perspective view of the frame of the liquid jet recording head of FIGS. 12A and 12B.

While the configuration of the first embodiment of liquid jet recording head according to the invention is described below, the present invention is by no means limited thereto.

[First Embodiment]

Referring to FIGS. 3 and 4 illustrating the first embodiment of liquid jet recording head according to the invention, the liquid jet recording head 100 comprises a head chip 15 that is a liquid jet ejection unit adapted to eject liquid droplets and a frame 16 that is a frame unit adapted to hold the head chip 15, said frame 16 having a printing liquid storage chamber (second common liquid chamber) typically containing printing liquid to be supplied to the head chip 15. The head chip 15 has a liquid droplet ejecting section adapted to eject liquid droplets through ejection orifices (nozzles) arranged in a row according to a printing signal applied thereto and a sheet-shaped wiring member, which may be realized in the form of a flexible cable or TAB and adapted to receive the printing signal from the main body of the liquid jet recording apparatus on which the liquid jet recording head 100 is mounted and forward it to the liquid droplet ejecting section.

Now, a possible configuration of the head chip 15 will be described below.

As shown in FIGS. 1 and 2, the head chip 15 comprises a base plate 3 and a belt-shaped heater board 1 extending in a direction on the base plate 3 and rigidly secured to the base plate 3. The heater board 1 is obtained by forming on a silicon substrate an ejection heater 1*a* that includes energy generating elements, or electro-thermal transducers, for generating energy necessary for ejecting printing liquid through the ejection orifices and wires for feeding the ejection heater 1*a* with electric power, by a silicon film forming process. A wiring substrate 2 is bonded onto the base plate 3. The wiring substrate 2 is designed to electrically contact with the wires for the heater board 1 and also with the liquid jet recording apparatus main body. A PWB substrate in which a wiring pattern is formed by using copper or nickel on a glass epoxy resin substrate or a TAB or FPC in which a wiring pattern is formed on a flexible film may typically be used for the wiring substrate 2. The heater board 1 and the wiring substrate 2 are electrically connected to each other typically by wire bonding or lead bonding.

The base plate 3 is typically made of aluminum or ceramic and adapted to operate as base plate for supporting the heater board 1. The base plate 3 also operates as a heat sink for cooling the heater board 1 by discharging heat from the heater board 1 that is generated as a result of driving the liquid jet recording head 100 for ejecting liquid. The base plate 3 is provided with a groove 3*d* on the surface where the heater board is mounted and bonded. The groove 3*d* extends in the longitudinal direction of the heater board 1.

Heater board 1 is bonded to the base plate by an adhesive agent with a high thermal conductivity so that heat accumulated in the heater board 1 may be efficiently emitted from it. Silver paste prepared by causing epoxy resin to contain powdery silver is typically used for such an adhesive agent. The heater board 1 is bonded onto the base plate by die bonding, using silver paste. Since silver paste is poured into the groove 3*d* on the base plate 3 along the longitudinal direction thereof, silver paste can be applied to a limited area with ease and prevented from flowing out from the bonding zone for bonding the base plate 3 and the heater board 1. In other words, silver paste is prevented from being consumed excessively.

Since silver paste is typically prepared by using an epoxy type adhesive agent, it has to be forced into a chemical reaction by heating it. The viscosity of epoxy adhesive agent is temporarily reduced when it is heated so that the fluidity of the epoxy adhesive agent is raised as a result of the reduced viscosity. Thus, the groove 3*d* will be completely filled with the epoxy adhesive agent.

Therefore, the groove 3*d* is preferably arranged with a limited area on the base plate 3 in the region where the heater board 1 is mounted on the base plate 3. However, if silver paste is applied in an amount that exceeds the intended volume, the excessive silver paste will flow longitudinally along the groove 3*d* and be prevented from flowing to the front surface of the liquid jet recording head 1, provided that the groove 3*d* extends to the opposite ends of the base plate 3.

The wiring substrate 2 is mounted on the base plate 3 at a position behind the heater board 1 and bonded onto the base plate 3 typically by means of a tacky adhesive agent.

The partition walls of a plurality of flow-path-forming grooves 7 through which printing liquid flows are bonded to the front surface of the heater board 1 at respective positions located close to the ejection heater 1*a*. Similarly, a top plate 5 is bonded to the front surface of the heater board 1 by way of the walls that define the first common liquid chamber 8, which communicates to the flow-path-forming grooves 7. Thus, the flow-path-forming grooves 7 that are separated from each other by the partition walls formed on the heater board 1 and operate as nozzles are found on the heater board 1, and the top plate 5 operates as the top walls of the liquid flow paths of printing liquid and also as the top wall of the first common liquid chamber 8 that communicates to the liquid flow paths. The first common liquid chamber 8 communicates to the flow-path-forming grooves 7 and contains printing liquid to be fed to the flow-path-forming grooves 7. A supply port 9 is formed at a part of the top plate 5 and operates for receiving printing liquid being supplied from a tank (not shown) storing printing liquid by way of the second common liquid chamber 21, which will be described hereinafter by referring to FIG. 5, so as to lead it into the first common liquid chamber 8. The top plate 5 is typically made of silicon, silicon nitride, glass, ceramic or the like and formed by anisotropic etching or molding.

The flow-path-forming grooves 7 are arranged on the heater board 1 in such a way that they are aligned respectively with the corresponding ejection heaters 1*a*. The flow-path-forming grooves 7 are formed on the heater board 1 by forming a photosensitive resin layer, which is typically made of epoxy, on the top surface of the heater board 1 and subsequently subjecting it to a photolithography process, which may typically be an etching process in such a way that any adjacently located flow-path-forming grooves 7 are separated from each other by a partition wall.

After the process of preparing the heater board 1 and the top plate 5, the top plate 5 and the heater board 1 are bonded together (top plate bonding) so that the flow-path-forming grooves 7 are found between the top plate 5 and the heater board 1, and the (open) upper limits of the flow-path-forming grooves 7 are closed by the top plate 5. In this way, flow-path-forming grooves 7 are made to operate as nozzles between the heater board 1 and the top plate 5. The operation of top plate bonding is performed typically by using an adhesive agent that can excellently withstand printing liquid to be used for recording.

Note, however, that the heater board 1 and the top plate are bonded to each other not necessarily after the above described die bonding process where the base plate 3 is bonded to the heater board 1. Alternatively, the die bonding process of bonding the base plate 3 to the heater board 1 may be conducted after the process of bonding the top plate 5. In the following description of the embodiment, it is assumed for the sake of convenience that the top plate 5 is bonded after the die bonding process.

As pointed out above, the flow-path-forming grooves 7 are not necessarily formed on the heater board 1. Alternatively, they may be formed by forming partition walls of photosensitive resin on the bottom surface of the top plate 5. Then, the flow-path-forming grooves 7 are formed in the top plate 5. If the flow-path-forming grooves 7 are formed on the top surface of the heater board 1, the flow-path-forming grooves 7 and the corresponding ejection heaters 1*a* are highly accurately aligned with each other by utilizing the semiconductor film forming technology. If, on the other hand, the flow-path-forming grooves 7 are formed on the bottom surface of the top plate 5, the flow-path-forming grooves 7 and the corresponding ejection heaters 1*a* are highly accurately aligned with each other by way of a mechanical alignment process.

An orifice plate 6 is then bonded to the front end face of the heater board 1 and that of the top plate 5. The orifice plate 6 is provided with a desired number of ejection orifices through which printing liquid is ejected toward the recording medium from the flow-path-forming grooves 7. The orifice plate 6 is typically made of a metal plate of a metal material such as SUS (stainless steel), Ni, Cr or Al, molded resin of a resin material such as polyimide, polysulfone, polyethersulfone, polyphenyleneoxide, polyphenylenesulfide or polypropylene, resin films, silicon or ceramic.

The heater board 1 and the top plate 5 are tightly put together by means of a tension plate 10, which tension plate 10 presses the top surface of the top plate 5 at a transversal median position thereof. More specifically, the tension plate 10 has a pair of substantially C-shaped bent sections 10*a* (only one of which is shown in FIG. 2) arranged respectively at opposite ends and inserted into respective notches 3*a* formed in the base plate 3 in such a way that the detent formed at the front end of each of the bent sections 10*a* is engaged with the bottom surface of the base plate 3. As a result, the pressure generating section 10*c* of the tension plate 10 presses the top surface of the top plate 5 so that the top plate 5 and the heater board 1 are sandwiched between the tension plate 10 and the base plate 3. In other words, a load of a selected magnitude is applied to the heater board 1 and the base plate 3 by the tension spring 10 in a direction perpendicular to their bonding surfaces. Thus, the heater board 1 and the base plate 3 are forcibly put together by the bonding force of the adhesive agent and the physical load applied by the tension plate 10. It may be appreciated that the physical load applied by the tension plate 10 is not always necessary. If no physical load is applied, the heater board 1 and the base plate 3 are put together by the bonding force of the adhesive agent.

The head chip 15 is provided with a chip tank 11 where a printing liquid supply path 11*a* is formed to lead printing liquid from the second common liquid chamber located at an upstream position of the liquid jet recording head 100 to the supply port 9. The chip tank 11 is provided with a front plate section 11*b*, which front plate section 11*b* takes a role of holding the orifice plate 6 as outer peripheral areas of the ejection orifices 6*a* of the orifice plate 6 are bonded to it and also a role of supporting the orifice plate 6 so that the latter may withstand the force exerted onto it when the cap member arranged on the main body of the recording apparatus is applied to the orifice plate 6 to cap the ejection orifices 6*a* and moved away from the orifice plate 6.

The orifice plate 6 is bonded to the front end face 1*b* of the heater board 1 and the front end face 5*b* of the top plate 5 typically by means of an epoxy type adhesive agent. FIG. 2 shows the orifice plate 6 before the bonding, whereas FIG. 1 shows the orifice plate 6 after the bonding.

As shown in FIGS. 2 and 7, the chip tank 11 and the top plate 5 are bonded to each other with the printing liquid supply path 11*a* of the chip tank 11 communicating to the supply port 9 of the top plate 5. The chip tank 11 and the top plate 5 are bonded to each other as they are put together under pressure. They are completely bonded to each other as a filling agent (not shown) is applied to the periphery of their bonded surfaces.

Now, the configuration of the frame 16 will be discussed below.

As shown in FIGS. 3 through 5 and 7 through 9 and described above, the frame 16 operates as a cabinet of the liquid jet recording head 100. The frame 16 is provided in the inside thereof with the second common liquid chamber 21 that can contain printing liquid by a desired amount and store it temporarily or until it is used up (see FIG. 5).

As shown in FIGS. 7 and 8, a porous member 12 is arranged along the boundary of the chip tank 11 and the second common liquid chamber 21. The porous member 12 shows a large pressure loss relative to liquid. It has micropores for trapping impurities contained in printing liquid. In this embodiment, the porous member 12 is bonded to the chip tank 11 by means of fusion bonding. Thus, no gas will enter the inside of the liquid jet recording head 100 through the area where the chip tank 11 and the porous member 12 are bonded to each other.

With the above described arrangement of the liquid jet recording head 100, printing liquid stored in the second common liquid chamber 21 is supplied to the head chip 15 by way of the porous member 12 and then to the nozzle section (flow-path-forming grooves 7) by way of the printing liquid supply path 11*a* and the first common liquid chamber 8 of the top plate 5.

The liquid jet recording head 100 is provided at an upper part thereof with a handle 22. The handle 22 is intended to be used when the user fits the liquid jet recording head 100 to the carriage (not shown) of the main body of the liquid jet recording apparatus and when he or she removes it from the latter. The main body of the liquid jet recording apparatus includes a conveyance means for conveying a recording medium, which may be a sheet of paper, in a direction, and a carriage adapted to reciprocate in a direction substantially perpendicular to the moving direction of the recording medium.

The wall of the frame 16 is provided with a plurality of cylindrical holes, into which joint rubber members 23 are inserted respectively as pegs. Each of the joint rubber members 23 has a fissure hole 23*b* for allowing a needle member to be inserted from a side 23*a* to the opposite side thereof. The joint rubber member 23 has a substantially cylindrical profile and provides a supply port to be used for supplying printing liquid from the outside of the liquid jet recording head 100 to the inside of the second common liquid chamber 21. The joint rubber member 23 is forced into a cylindrical hole under pressure that is formed in the frame 16 and has a diameter smaller than that of the joint rubber member 23. In other words, the cross section of the joint rubber member 23 as viewed in a direction perpendicular to the central axis thereof is greater than the cross section of the corresponding cylindrical hole of the frame 16 as viewed in a direction perpendicular to the longitudinal axis thereof. Additionally, the front end of the joint rubber member 23 that operates as the leading end when the member is forced into the cylindrical hole under pressure is tapered so that it may be introduced into the cylindrical hole with ease. As the joint rubber member 23 is forced into the cylindrical hole under pressure, the fissure hole 23*b* contracts due to the load applied to the joint rubber member 23 from the outer periphery of the latter. Thus, the second common liquid chamber 21 is hermetically sealed when a needle member 51 as shown in FIG. 6B is not inserted into the joint rubber member 23. The needle member 51 is provided to the liquid jet recording apparatus main body so as to be used for supplying printing liquid.

When supplying printing liquid from the tank arranged in the liquid jet recording apparatus main body into the liquid jet recording head 100, a hollow needle member 51 provided to the liquid jet recording apparatus main body as printing liquid supply means is driven into the corresponding joint rubber member 23, the tip thereof being used as the leading end. The liquid jet recording apparatus main body is also provided with a drive means for driving the needle member 51 so that the needle member 51 can be moved back and forth by the drive means relative to the joint rubber member 23 of the liquid jet recording head 100 that is moved to a predetermined position as a result of movement of the carriage. Then, printing liquid is supplied from the tank in the liquid jet recording apparatus main body into the second common liquid chamber 21.

As each needle member 51 is driven into a corresponding one of the joint rubber member 23 as shown in FIG. 6A, the needle member 51 is held under gripping force (compressive force from the periphery) caused by the joint rubber member 23 so that the boundary of the joint rubber member 23 and the needle member 51 is completely closed.

As each joint rubber member 23 is provided with a fissure hole 23*b* into which a pipe member is inserted in a manner described hereinafter so that the needle member 51 may be moved back and forth along the fissure hole 23*b* with ease. Thus, the load applied to the needle member 51 when the latter is moved back and forth is reduced. In other words, a replacement liquid jet recording head can be handled with ease when it is put into use.

Additionally, if the central axis of the needle member 51 and that of the joint rubber member 23 are misaligned relative to each other, the joint rubber member 23 is easily depressed from the surrounding wall of the fissure hole 23*b* when the needle member 51 is driven into the joint rubber member 23 and the tip of the needle member 51 applies pressure to the surrounding wall. In other words, the needle member 51 is easily inserted into the second common liquid chamber 21 as it is guided by the fissure hole 23*b*. Thus, no particular precision is required for the dimensions of the section (not shown) arranged in the liquid jet recording apparatus main body for holding the needle members 51, the needle members 51, the joint rubber members 23, the frame 16*b* and other related parts nor for the operation of assembling them from the viewpoint of accurately and reliably driving the needle members into the corresponding joint rubber members 23. Therefore, the liquid jet recording head and the liquid jet recording apparatus main body can be provided at relatively low cost.

In the liquid jet recording head 100 of this embodiment, two joint rubber members 23 are provided respectively at upper and lower positions of the frame 16. The lower joint rubber member 23 is arranged in the supply path for supplying printing liquid from an external printing liquid storage tank (not shown) (to be referred to as main tank hereinafter) arranged in the liquid jet recording apparatus main body into the second common liquid chamber 21. Thus, printing liquid is supplied from the main tank into the second common liquid chamber 21 by way of the lower needle member 51 and the lower hole 16*b* of the frame 16.

On the other hand, the upper joint rubber member 23 is arranged in the air suction path for releasing air in the second common liquid chamber 21 to the outside and controlling the negative pressure in the second common liquid chamber 21. Thus, air is forced out of the second common liquid chamber 21 by means of an air suction means such as pump by way of the upper hole 16*a* and the upper needle member 51. Therefore, the operation of supplying printing liquid into the second common liquid chamber 21 can be controlled by raising the negative pressure in the second common liquid chamber 21 by means of the air suction path and the air suction means.

As shown in FIGS. 4 and 9 and described above, a pad forming section 24 is arranged at an end of the wiring substrate 2. A number of contact pads 24*a* are formed on the pad forming section 24 so as to be used for receiving a printing signal transmitted from the liquid jet recording apparatus main body and forwarding it to the head chip 15.

Now, the connection between the head chip 15 and the frame 16 will be described below.

Referring to FIGS. 8 and 9, the head chip 15 is secured to the frame 16 typically by fusion bonding, using centering bosses 16*c*, 16*d* arranged on the frame 16 as shown in FIG. 9, and/or by means of screws 26 so that both the head chip 15 and the frame 16 may easily be dismantled. A filling agent 25 typically made of silicon rubber or the like is filled into the connecting section connecting the frame 16 and the chip tank 11. After aligning the wiring substrate 2 and the frame 16 so that the contact pads 24*a* are located at respective right positions on the frame 16, the wiring substrate 2 is bonded to the corresponding lateral surface of the frame 16.

Now, the components of the embodiment will be described in greater detail below.

In a state where the liquid jet recording head 100 is mounted on the carriage of the liquid jet recording apparatus, the ejection orifice side of the liquid jet recording head 100 where the ejection orifices 6*a* are arranged is constantly located above the level of the printing liquid in the main tank 2, and the liquid jet recording head 100 and the main tank are connected to each other by way of the liquid supply path so that the inside of the second common liquid chamber 21 is held under negative pressure.

The second common liquid chamber 21 takes the role of a buffer for temporarily storing printing liquid. As printing liquid is ejected through the ejection orifices 6*a* and consumed, printing liquid is appropriately supplied from the second common liquid chamber 21 to the first common liquid chamber 8, which is defined by the top plate 5 and the heater board 1. As described above, the second common liquid chamber 21 is provided at the wall thereof with a connecting section through which it receives printing liquid from the main tank arranged externally relative to the liquid jet recording head 100 and also a connecting section for releasing air from the second common liquid chamber 21 to the outside.

As pointed out above, a filling agent 25 completely fills the connecting section connecting the frame 16 that defines the second common liquid chamber 21 and the chip tank 11 along the entire periphery thereof, so that the internal space between the inside of the second common liquid chamber 21 and the chip tank 11 are perfectly held in a liquid-tight condition. However, since the filling agent 25 is made of silicon rubber or the like that allows gas to permeate, outer air can penetrate into the second common liquid chamber 21 through the filling agent 25. The gas that has flown into the second common liquid chamber 21 is lifted by buoyancy in the second common liquid chamber 21 and stays in the upper gas layer in the liquid chamber. However, the gas is eventually released to the outside of the second common liquid chamber 21 by way of the connecting section adapted to release gas from the inside of the second common liquid chamber 21 to the outside.

In this embodiment, the connecting sections connecting the chip tank 11 and the second common liquid chamber 21 are located upstream relative to the porous member 12 from the viewpoint of the flowing direction of printing liquid. More specifically, the porous member 12 is arranged at the upstream end in the chip tank 11. Therefore, gas that has permeated through the filling agent 25 would not get into the downstream side in the inside of the chip tank 11 relative to the porous member. Furthermore, if the printing liquid contained in the second common liquid chamber 21 is partly dried and solidified to produce solid, the solid is trapped by the porous member 12.

With the above described arrangement, it is possible to reduce the amount of gas penetrating into the flow path in a stretch downstream relative to the porous member 12, or between the printing liquid supply path 11*a* and the nozzles of the head chip 15. As a result, any adverse effect of gas on the liquid jet performance of the liquid jet recording head 100 is minimized if such gas is found in the part of the flow path located downstream relative to the porous member 12.

Additionally, since the amount of gas found in the part of the flow path located downstream relative to the porous member 12 is reduced, the recovery operation that may be needed when the liquid jet recording head 100 is to be operated after a long pause can be simplified. As a result, the printing liquid that is sucked from the nozzles in the recovery operation of the liquid jet recording head 100 is reduced to improve the economy of consumption of printing liquid.

The porous member 12 is arranged obliquely relative to the flowing direction of printing liquid in the printing liquid supply path 11*a* of the chip tank 11. This means that the surface area of the porous member 12 is greater than the area of the cross section of the flow path as viewed in a direction perpendicular to the flowing direction of printing liquid at a position near the connecting section connecting the chip tank 11 and the second common liquid chamber 21. As a result of this arrangement of the porous member 12, air bubbles that have been produced when the liquid jet recording head 100 ejected liquid droplets and raised in a direction opposite to the direction of supplying printing liquid in the printing liquid supply path 11*a* are trapped at and near the upper side (upstream side) of the porous member 12.

On the other hand, the lower side (downstream side) of the obliquely arranged porous member is constantly held in contact with printing liquid so that the flow of printing liquid from the second common liquid path 21 to the printing liquid supply path 11*a* of the chip tank 11 by way of the porous member 12 is never interrupted. Thus, printing liquid is constantly supplied to the chip head at a constant flow rate necessary for the liquid jet recording head 100 to eject liquid droplets. While the porous member 12 of this embodiment is arranged obliquely relative to the flowing direction of printing liquid, it may alternatively be arranged perpendicularly relative to the flowing direction of printing liquid.

[Second Embodiment]

Now, a second embodiment of liquid jet recording head according to the invention will be described by referring to the related drawings. This embodiment differs from the above described first embodiment in terms of the mode of bonding the frame and the head chip and the sequence of bonding them in the manufacturing process. Otherwise, this embodiment can be made the same as the first embodiment particularly in terms of the structure of the liquid droplet ejecting section, that of the second common liquid chamber and the method of supplying liquid to the second common liquid chamber.

Therefore, the components of this embodiment that are the same as those of the first embodiment are denoted respectively by the same reference symbols and only the parts that are different from the first embodiment will be described below. FIGS. 12A and 12B are schematic perspective views of the second embodiment of liquid jet recording head according to the invention, of which FIG. 12A is a schematic perspective view of the assembled liquid jet recording head and FIG. 12B is an exploded perspective view of the liquid jet recording head. FIG. 13 is a schematic perspective view of the frame of the second embodiment of liquid jet recording head.

Referring to FIGS. 12A, 12B and 13, reference symbols 65 and 66 respectively denote a head chip and a frame. The frame 66 is provided with snap-fit members 66*a*, 66*b*, 66*c*, 66*d* and centering bosses 66*e*, 66*f*. On the other hand, the head chip 65 is provided with corresponding parts including receiving sections 65*a*, 65*b*, 65*c*, 65*d* and centering holes 65*e*, 65*f*. The centering bosses 66*e* and 66*f* of the frame 66 are respectively aligned with and inserted into the corresponding centering holes 65*e* and 65*f* (not shown) of the head chip 65 and the snap-fit members 66*a*, 66*b*, 66*c*, 66*d* of the frame 66 are respectively brought into engagement with the corresponding receiving sections 65*a*, 65*b*, 65*c*, 65*d* of the head chip 65, so that the head chip 65 and the frame 66 are bonded to each other.

Reference symbol 67 denotes a sealing member typically made of elastomer and adapted to hermetically seal the second common liquid chamber 21 as it is sandwiched between the head chip 65 and the frame 66.

In this way, the reliability of the bonding sections of the frame 66 and the head chip 65 is secured in a stable fashion in the manufacturing process. Therefore, it may be possible to carry out a printing test by using only the head chip, which is then bonded to the frame 66 after the test.

Now, a method of packing the liquid jet recording head 100 will be described below.

When packing the liquid jet recording head 100, a pipe member 32 is driven into each of the joint rubber members 23 like the needle member 51 to be used for supplying printing liquid as shown in FIGS. 11A and 12B. The pipe member 32 makes the inside of the second common liquid chamber 21 communicate to a peripheral section of the liquid jet recording head 100 in order to establish equilibrium of pressure between them. The pipe member 32 is typically made of a resin material such as polytetrafluoroethylene ("Teflon" available from Du Pont in U.S. to be more specific), polysulfone, polyethersulfone, polyphenylenesulfide or the like that is highly resistant to both chemicals and printing liquid or stainless steel. If the pipe member 32 is made of a resin material, it can advantageously be manufactured on a mass production basis, using the technique of extrusion molding, at very low cost.

As the pipe member 32 is driven into the joint rubber member 23, it is firmly gripped by the latter (due to the compressive force applied to the outer periphery of the pipe member 32), so that it is prevented from moving and coming out of the joint rubber member 23 if the liquid jet recording head 100 is subjected to vibrations and/or impacts. Therefore, the joint rubber member 23 can securely hold the pipe member 32 if the latter is made very short so as to reduce the cost of the pipe member 32 that is a packing member.

If a fissure hole 23*b* is formed in the joint rubber member 23 in advance typically by driving a needle or the like, which will be described hereinafter, the front end of the pipe member 32 is advantageously be guided by the fissure hole 23 when the pipe member 32 is driven into the joint rubber member 23. However, it may alternatively be so arranged that the fissure hole 23*b* is produced when the pipe member is driven into the joint rubber member 23. FIG. 11B shows pipe members 32 before being driven into the corresponding joint rubber members. While more than one pipe members are shown, only a single pipe member may be used as shown in FIG. 12B.

Now, a preferable method of packing the liquid jet recording head 100 will be described in greater detail.

Firstly, when packing the liquid jet recording head 100, which is adapted to eject large liquid droplets with a diameter of 10 pl or more, an easily removable sealing member that is a protection tape 31 is preferably applied to the entire ejection surface 6*b* of the orifice plate 6 where ejection orifices 6*a* are arranged in a manner as shown in FIG. 10, so that the ejection orifices 6*a* are hermetically sealed by the protection tape 31. As a result of applying a protection tape 31 to the ejection surface 6*b* of the orifice plate 6, printing liquid is prevented from leaking out at and hear the nozzles and also from drying in the region, or in the nozzles.

Then, a protection cap (not shown) is fitted to the liquid jet recording head 100 so as to press the protection tape 31 against the orifice plate 6 and improve the adhesion of the protection tape 31 to the orifice plate 6. In other words, the protection cap is designed to improve the effect of sealing the ejection orifices 6*a*. Therefore, the use of such a protection cap may be omitted if a desired sealing effect is secured.

As the ejection orifices 6*a* are sealed by the protection tape 31, the printing liquid in the chip tank 11 (and hence in the printing liquid supply path 11*a*) is confined to the region between the protection tape 31 and the porous member 12 and prevented from moving out of the region. More specifically, the pressure loss of the liquid is raised by the porous member 12 and hence the printing liquid is prevented form passing through it.

If, on the other hand, the liquid jet recording head 100 is adapted to eject small liquid droplets with a diameter less than 10 pl, the meniscus retaining effect of the ejection orifices is high and the printing liquid is prevented from moving so that the liquid jet recording head can be packed without using a sealing means such as a protection tape. However, a cap or a similar member may normally be used to prevent the ejection orifices and their neighboring areas from being damaged by external force.

In the case of the first embodiment of liquid jet recording head, subsequently the printing liquid supplied for a printing test and remaining in the second common liquid chamber 21 is preferably expelled to the outside by driving the needle member for suctioning printing liquid from the lower joint rubber member 23 into the second common liquid chamber 21 and driving the needle member for allowing gas to flow from the upper joint rubber member 23 into the second common liquid chamber 21. As pointed out above, the printing liquid in the printing liquid supply path 11*a* can hardly flow out into the second common liquid chamber 21 because of the provision of the porous member 12. Therefore, the printing liquid in the second common liquid chamber 21 can be removed with ease.

After removing the printing liquid in the second common liquid chamber 21, the two needle members are pulled out and the pipe members 32 are respectively driven into the corresponding joint rubber members 23 through the respective fissure holes 23*b*.

In the case of the second embodiment of liquid jet recording head, the head chip 65 and the frame 66 can be connected to each other after the printing test. In other words, it is not necessary to fill the inside of the second common liquid chamber 21 with printing liquid. Therefore, the step of removing liquid from the inside of the second common liquid chamber 21 is not required so that the productivity of manufacturing liquid jet recording heads can be improved. While the pipe member 32 is driven into the peg member before connecting the head chip 65 and the frame to each other in FIGS. 12A and 12B, it may alternatively be driven into the peg member after connecting them.

Subsequently, the liquid jet recording head 100 is contained in the inside of the packing material and preferably the entire periphery of the packing member is sealed. A material that can effectively block permeation of gas and liquid is preferably used for the packing material in order to prevent printing liquid from evaporating from the inside of the liquid jet recording head 100. Specific examples of such materials include aluminum and silicon-deposited films.

Now, a preferable mode of unpacking and installing the liquid jet recording head 100 that has been packed in a manner as described above will be discussed below.

The liquid jet recording head 100 is unpacked and exposed by removing the packing material of the liquid jet recording head 100. After the liquid jet recording head 100 is taken out of the packing material and mounted on the carriage of the liquid jet recording apparatus main body, the needle member 51 is moved toward the liquid jet recording head 100 and completely driven into the joint rubber member 23. At this time, the front end of the needle member 51 pushes the pipe member 32 that is held in the joint rubber member 23 into the second common liquid chamber 21. In other words, the pipe member 32 is detached from the joint rubber member 23 and falls onto the bottom of the second common liquid chamber 21.

As a result, the pipe member 32 is dipped in the printing liquid contained in the second common liquid chamber 21. However, the pipe member 32 would not be eroded by printing liquid provided that the pipe member 32 is made of a material that is highly resistant to printing liquid as pointed out earlier. Additionally, the pipe member 32 would not block the flow of printing liquid in the second common liquid chamber 21 if it is found on the porous member 12 so long as the pipe member 32 is made smaller than the porous member 12.

If the pipe member 32 is made of Teflon, the friction that occurs when the pipe member 32 is driven into the fissure hole 23*b* is reduced because of the smooth touch of Teflon so that the operation of driving the pipe member 32 into the joint rubber member can be conducted efficiently in the packing process.

With the above described mode of unpacking and installing the liquid jet recording head 100, it is not necessary for the operator to pull out the pipe member 32 from the joint rubber member 23 when mounting the liquid jet recording head 100 on the carriage. Thus, the operation of installing the liquid jet recording head 100 is easy and simple. Additionally, the pipe member 32 does not need to be disposed as waste after installing the liquid jet recording head 100. This makes the pipe member highly friendly to the environment.

In the state where the pipe member 32 is held in the fissure hole 23*b* of the joint rubber member 23, the opening of the fissure hole 23*b* is expanded by the pipe member 32. Thus, the friction that occurs between the needle member 51 and the joint rubber member 23 is reduced when the needle member 51 is driven into the fissure hole 23*b* so that the needle member 51 can be driven into the fissure slog 23*b* with a very small effort. Therefore, it is not necessary to make the cabinet section for holding the needle in the liquid jet recording apparatus main body very rigid and hence the cost of the entire liquid jet recording apparatus can be further reduced.

As pointed out above, the second common liquid chamber 21 is held in communication to the peripheral area of the liquid jet recording head 100 by way of the pipe member 32 in the packed state of liquid jet recording head 100, so that equilibrium of pressure is established between the second common liquid chamber 21 and the peripheral area of the liquid jet recording head 100 and hence the second common liquid chamber 21 is prevented from being completely closed. Therefore, if the liquid jet recording head 100 is subjected to an abrupt change in the environment, the internal pressure of the liquid jet recording head 100 is prevented from rising enormously.

Thus, now the sealing member of the filling agent 25 in the liquid jet recording head 100 is effectively prevented from being damaged. Similarly, the protection tape 31 is prevented from coming off from the orifice plate 6 and the packing material is prevented from being damaged as a whole. Furthermore, since the inside of the second common liquid chamber 21 is made free from printing liquid in the packed state, the risk of printing liquid flowing out from the liquid jet recording head 100 by way of the pipe member 32 is greatly alleviated if the liquid jet recording head 100 is subjected to an abrupt change in the environment.

As a result of using a pipe member 32 for packing the liquid jet recording head and driving it into the joint rubber member 23, it is now possible to reduce the cost of manufacturing liquid jet recording heads 100 and liquid jet recording apparatus that are adapted to consume liquid at a high rate. When packing the liquid jet recording head 100, the printing liquid in the liquid jet recording head 100 may be replaced by a liquid substitute from the viewpoint of storage and distribution.

[Advantages of the Invention]

As described above, with a method of packing a liquid jet recording head according to the invention, when packing the liquid jet recording head provided with a peg member made of an elastic material, into which a hollow needle member is to be driven in order to supply liquid to the inside of the liquid chamber of the liquid jet recording head, a pipe member is driven into the fissure hole of the peg member so as to be held by the peg member. As a result, the liquid chamber in the liquid jet recording head is not held to a completely closed state, so that the internal pressure of the liquid jet recording head is prevented from rising enormously if the liquid jet recording head is subjected to an abrupt change in the environment. This arrangement can reduce the cost of manufacturing liquid jet recording heads 100 and liquid jet recording apparatus that are adapted to consume liquid at a high rate. Additionally, in the case of a liquid jet recording head according to the invention into which liquid is supplied from a main tank in a liquid jet recording apparatus, no extremely large load is applied to the liquid jet recording head if the latter is subjected to an abrupt change in the environment. Therefore, the sealing member for sealing the filling agent in the liquid jet recording head is prevented from being damaged. Similarly, the sealing member for sealing the ejection orifices in the packing process is prevented from coming off and the packing material is prevented from being damaged as a whole.

What is claimed is:

1. A distribution package form of an ink-jet recording head prior to installation in an ink-jet apparatus, comprising:

an ink-jet head portion;

an ink tank portion connected to said ink-jet head portion, said ink tank portion constituting a storing portion for storing ink to be supplied to said ink-jet head portion;

a connecting portion provided in said ink tank portion, in which an ink supply pipe for supplying ink to said ink tank portion from outside of said ink tank portion is to be inserted to form a connection between said ink tank and the outside thereof while said ink-jet recording head is being used;

an elastic joint arranged in said connecting portion, through which said ink supply pipe can pass; and a pipe member for communicating air between an inside of said ink tank portion and the outside thereof, said pipe member being inserted and held in said elastic joint.

2. The distribution package form according to claim 1, wherein said pipe member is longer than a thickness of said elastic joint.

3. The distribution package form according to claim 1, wherein said pipe member is removed when said ink-jet recording head is installed in said ink-jet apparatus and said ink supply pipe is connected to said elastic joint.

4. The distribution package form according to claim 1, wherein said elastic joint has a fissure formed at a position at which said ink supply pipe is to be inserted, and said pipe member is inserted and held in the fissure.

5. The distribution package form according to claim 1, wherein a porous member is arranged at a second connecting portion that connects said ink-jet head portion and said ink tank portion, ink is present in a region between said ink-jet head portion and said porous member, and a region between said ink tank portion and said porous member is a region in which ink is not present.

6. The distribution package form according to claim 1, wherein an ink-ejecting portion provided in said ink-jet head portion is sealed with a sealing member.

7. The distribution package form according to claim 1, wherein said ink-jet recording head is packaged and put into distribution being entirely wrapped with a material having low gas permeability and low liquid permeability.

8. The distribution package form according to claim 1, wherein a plurality of connecting portions, each forming a connection between said ink tank and the outside thereof, are provided, an elastic joint is arranged in each of said connecting portions, and a pipe member is inserted and held in each of said elastic joints.

9. The distribution package form according to claim 1, wherein a plurality of connecting portions, each forming a connection between said ink tank and the outside thereof, are provided, an elastic joint is arranged in each of said connecting portions, and said pipe member is inserted and held in any one of said elastic joints.

* * * * *